US007225776B2

(12) United States Patent
Gecim et al.

(10) Patent No.: US 7,225,776 B2
(45) Date of Patent: Jun. 5, 2007

(54) VALVETRAIN WITH TWO-STEP SWITCHABLE ROCKER AND DEACTIVATING STATIONARY LASH ADJUSTER

(75) Inventors: Burak A. Gecim, Rochester Hills, MI (US); Ioan Manole, Chesterfield, MI (US); Vimesh M. Patel, Novi, MI (US)

(73) Assignee: General Motors Corporation, Detroit, MI (US)

( * ) Notice: Subject to any disclaimer, the term of this patent is extended or adjusted under 35 U.S.C. 154(b) by 190 days.

(21) Appl. No.: 10/990,936

(22) Filed: Nov. 17, 2004

(65) Prior Publication Data

US 2006/0102119 A1 May 18, 2006

(51) Int. Cl.
*F01L 1/18* (2006.01)

(52) U.S. Cl. ..... 123/90.39; 123/90.44; 123/90.45

(58) Field of Classification Search ..... 123/90.39, 123/90.44, 90.45, 90.46, 90.48, 90.52, 90.55; 74/559, 567, 569
See application file for complete search history.

(56) References Cited

U.S. PATENT DOCUMENTS 4,858,574 A * 8/1989 Fukuo et al. ..... 123/90.34
5,445,116 A * 8/1995 Hara ..... 123/90.16
6,321,704 B1 11/2001 Church et al. ..... 123/90.16
6,439,178 B1 8/2002 Pierik ..... 123/90.16
6,557,518 B1 5/2003 Albertson et al. ..... 123/198
6,668,779 B2 * 12/2003 Hendriksma et al. .... 123/90.44
6,701,879 B2 * 3/2004 Diehl et al. ..... 123/90.22
6,708,660 B2 3/2004 Seitz ..... 123/90.44
6,769,387 B2 8/2004 Hayman et al. ..... 123/90.39

* cited by examiner

*Primary Examiner*—Ching Chang
(74) *Attorney, Agent, or Firm*—Kathryn A. Marra

(57) ABSTRACT

The invention provides a valvetrain configuration in an internal combustion engine in which a plurality of two-step rockers enable the engine poppet valves to switch between two lift profiles. In addition, a lost-motion stationary lash adjuster enables the deactivation of the engine poppet valve. The integration of a two-step rocker with a deactivating stationary lash adjuster yields a better control of the combustion process, under different engine operating conditions than what is achievable with either one of these actuators acting alone. Preferably, the locking and unlocking of the two-step rocker arm and deactivating stationary lash adjuster is controlled by two on/off hydraulic valves in a hydraulic circuit, and a piloted check valve prevents hard landings between stationary and moving components within the stationary hydraulic lash adjuster.

9 Claims, 3 Drawing Sheets

VALVETRAIN WITH TWO-STEP SWITCHABLE ROCKER AND DEACTIVATING STATIONARY LASH ADJUSTER

TECHNICAL FIELD

This invention relates to a three-mode valvetrain for an internal combustion engine.

BACKGROUND OF THE INVENTION

Some prior art valvetrains are selectively adjustable to vary the amount of valve travel during opening. Typically, such valvetrains are selectively adjustable between a low-lift mode, in which the valvetrain causes an engine poppet valve to open a first predetermined amount (with lost motion), and a high-lift mode, in which the valvetrain causes the poppet valve to open a second predetermined amount that is greater than the first predetermined amount.

Lash adjusters are used to accommodate for build variations and wear in a valvetrain assembly. Known deactivating lash adjusters require significant length to achieve lost-motion, and can therefore be difficult to package.

SUMMARY OF THE INVENTION

The present invention relates to a valvetrain configuration in an internal combustion engine in which a plurality of two-step rockers enable the engine poppet valves to switch between two lift profiles. In addition, a lost-motion stationary lash adjuster enables the deactivation of the engine poppet valve. The integration of a two-step rocker with a deactivating stationary lash adjuster yields a better control of the combustion process, under different engine operating conditions, than what is achievable with either one of these actuators acting alone.

A two-step switchable rocker is provided wherein the arm that contacts the engine poppet valve at one end is supported by a lost-motion lash-adjuster at the other end. An overhead cam valvetrain incorporating these components is capable of operating in three distinct modes: low-lift mode, high-lift mode, and zero-lift mode (i.e., deactivated).

The combination of a two-step rocker with a deactivating lash adjuster results in dividing the total lost motion, dictated by the high-lift cam lobes, into two parts: one at the lash adjuster, and one at the two-step rocker. Hence, the length of the lash adjuster does not have to be based on the full lost-motion stroke, which would have been the case with a conventional single-step rocker. This feature is important for packaging.

More specifically, the invention provides a valvetrain including a camshaft having low-lift and high-lift cams, a two-step rocker arm assembly, and a deactivating stationary lash adjuster. The two-step rocker arm assembly has first and second movable portions engaged with the low-lift and high-lift cams, respectively, and a rocker arm spring biasing the first portion relative to the second portion, wherein the first and second portions are lockable together for high-lift mode, and unlockable for lost-motion mode. The deactivating stationary lash adjuster is engaged with the two-step rocker arm and has a lost-motion spring. The deactivating stationary lash adjuster is unlockable to enable lost-motion movement against the lost-motion spring when unlocked. The two-step rocker arm and deactivating stationary lash adjuster are unlockable simultaneously for improved lost-motion control of a corresponding engine poppet valve and to minimize required length of the deactivating stationary lash adjuster.

Preferably, the locking and unlocking of the two-step rocker arm and deactivating stationary lash adjuster is controlled by two on/off hydraulic valves in a hydraulic circuit. The hydraulic circuit includes a spring-biased piloted check valve operatively connected between the two on/off hydraulic valves to prevent unlocking of the deactivating stationary lash adjuster when the two-step rocker arm is locked to prevent a hard landing between moving and stationary parts within the deactivating stationary lash adjuster.

Preferably, the lost-motion spring in the deactivating stationary lash adjuster is stiffer than the rocker arm spring so that both springs may be compressed simultaneously to achieve lost motion in both the deactivating stationary lash adjuster and the two-step rocker arm. The two-step rocker arm and deactivating stationary lash adjuster enable operation of the engine poppet valve in low-lift mode, high-lift mode and zero-lift mode.

The invention also provides a method of controlling an engine poppet valve in a valvetrain, including: (a) providing a two-step rocker arm and deactivating stationary lash adjuster operatively connected to a cam shaft having low-lift and high-lift cams for opening and closing the engine poppet valve; and (b) selectively locking and unlocking the two-step rocker arm and the deactivating stationary lash adjuster in a manner to provide three modes of operation of the engine poppet valve, including a low-lift mode, a high-lift mode and a zero-lift mode.

The above features and advantages, and other features and advantages of the present invention are readily apparent from the following detailed description of the best modes for carrying out the invention when taken in connection with the accompanying drawings.

DESCRIPTION OF THE PREFERRED EMBODIMENTS

Figure 1C:
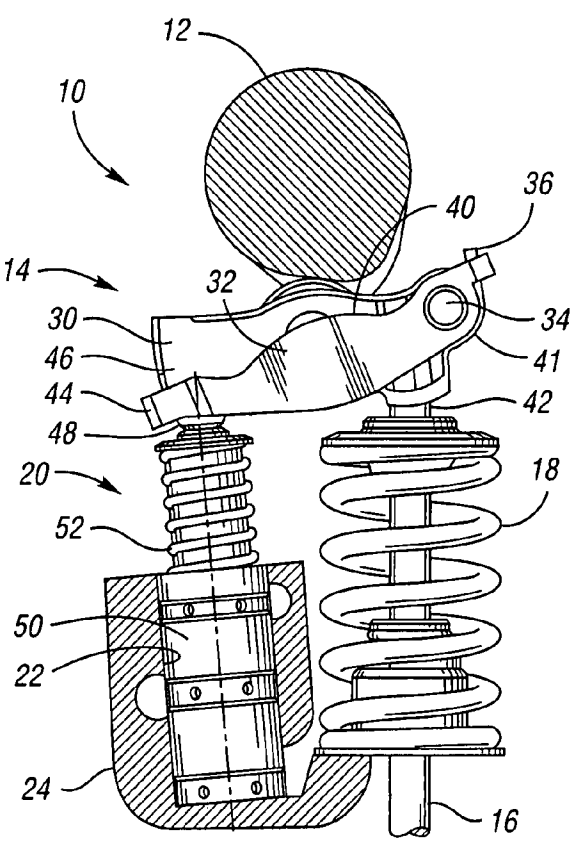
FIG. 1*c* shows a vertical cross-sectional view of the valvetrain assembly of FIGS. 1*a* and 1*b*, wherein most lost motion is achieved within the two-step rocker arm.

According to the recent art on switchable rockers, such as commonly assigned U.S. Pat. No. 6,769,387, entitled "Compact Two-Step Rocker Arm", and hereby incorporated by reference in its entirety, the basic kinematic arrangement for a switchable rocker includes two arms pivoted at one end using a pin joint, therefore, having a freedom of relative rotation with respect to each other. This rotational motion takes place against a biasing spring placed between the arms, preloaded in assembly urging each arm to rotate away from each other. Each arm encompasses a follower segment in contact with a respective cam lobe. The two cam lobes, defined as the high-lift cam lobe and the low-lift cam lobe, act simultaneously on their respective follower surfaces. The arm that follows the motion of the low-lift cam lobe is pivoted at one end and contacts the engine poppet valve at the other end. In the low-lift mode of operation of the engine poppet valve, the low-lift cam lobe is the controlling motion generator. In this mode, the high-lift cam lobe displaces its respective follower to idle in relative rotational motion centered around the pin joint. In the high-lift mode of operation of the engine poppet valve, a mechanical-locking device is hydraulically actuated to prevent the relative rotational motion of the two arms with respect to each other. Because the displacement of the high-lift cam lobe is larger than the low-lift cam lobe, the high-lift cam lobe becomes the controlling motion generator. The locking device may be a circular pin located on one of the arms, hydraulically actuated against a biasing spring, and urged towards a receiving circular opening located on the other arm. Upon decrease of the actuation pressure, the actuation pin is retracted out of the receiving opening, thereby switching the control of the engine poppet valve motion back to the low-lift cam lobe.

According to the recent art related to deactivating stationary lash adjusters, the basic kinematic arrangement of a deactivating stationary lash adjuster includes an inner body slidably disposed inside an outer body, where the two bodies can be locked by means of latching elements. The latching elements are usually located on the inner body and urged towards a receiving groove located on the outer body by biasing springs. In the engine poppet valve active mode, the inner and the outer bodies remain locked, and the pivoting contact between the lash adjuster and the rocker remains fixed with respect to the engine head. In this mode of operation, a conventional lash-adjusting device located inside the inner body provides lash compensation and improved valvetrain stiffness. In the engine poppet valve deactivated mode, an increase in the hydraulic actuation pressure on the latching elements' outer surface will urge the latching elements radially inward and out of the groove on the outer body. Hence, the stationary lash adjuster assembly can no longer act as a fixed pivot for the rocker. Cam displacement is imparted onto the slidable inner body and urged to move against a lost motion biasing spring. In this mode operation, the rocker is pivoted at the valve tip. Upon lowering of the hydraulic actuation pressure, the latching element biasing springs will urge the elements to move back into the receiving grove on the outer body at a moment in the cycle when the elements are lined up with the receiving groove. This will prevent the relative motion between the inner and the outer bodies, and will switch the mode of operation back to the engine poppet valve active mode.

The present invention specifically relates to a valvetrain configuration employing both a two-step rocker and a deactivating stationary lash adjuster, as those components are described above.

Referring to FIGS. 1*a–c* and FIG. 3, the valvetrain assembly 10 includes a cam shaft 12 engaged with a two-step rocker arm (or two-step rocker arm assembly) 14 for actuating a poppet valve 16 against the force of a poppet valve spring 18. A stationary hydraulic lash adjuster 20 is positioned within an aperture 22 in the engine block 24 to engage the two-step rocker arm 14 in a manner to compensate for lash, and to selectively deactivate the poppet valve 16. The Figures only show a single rocker arm, valve and stationary lash adjuster, but, of course, in an engine multiples of each would be provided for each cylinder.

The cam shaft 12 includes low lift cams 26 and high lift cams 28. The two-step rocker arm 14 includes an inner arm 30 pivotally connected to an outer arm 32 about a pivot joint 34. A spring 36 engages both the inner and outer arms 30, 32 and is disposed about the pivot joint 34 for biasing the inner and outer arms 30, 32 in an opening direction. The inner arm 30 has a cam surface 38, shown in FIG. 1*b*, which is engageable with the low lift cam lobe 26, and the outer arms 32 have cam surface 40, shown in FIGS. 1*a* and 1*c*, which is engageable with the high lift cam lobe 28. At the first end 41 of the inner and outer arms 30, 32, the arms 30, 32 are pivotally connected together about the pivot joint 34, and are engaged with the stem 42 of the poppet valve 16 for opening and closing the poppet valve 16. The second end 44 of the outer arm 32 is selectively latchable and unlatchable with respect to the second end 46 of the inner arm 30 of the two-step rocker arm 14. This locking and unlocking is achieved hydraulically, as described above. The second end 46 of the inner arm 30 is engaged with a plunger 48 of the stationary hydraulic lash adjuster 20.

The stationary hydraulic lash adjuster 20 may be unlocked by unlatching the plunger 48 with respect to the body 50 of the stationary hydraulic lash adjuster 20 in a known manner, as described above, to achieve lost motion. Also, the two-step rocker arm 14 may have the inner and outer arms 30, 32 unlocked with respect to each other in a known manner, as described above, to achieve lost motion. Accordingly, lost motion may be achieved in both the two-step rocker arm 14 and in the stationary hydraulic lash adjuster 20, thereby providing low-lift, high-lift and zero-lift modes.

Figure 1B:
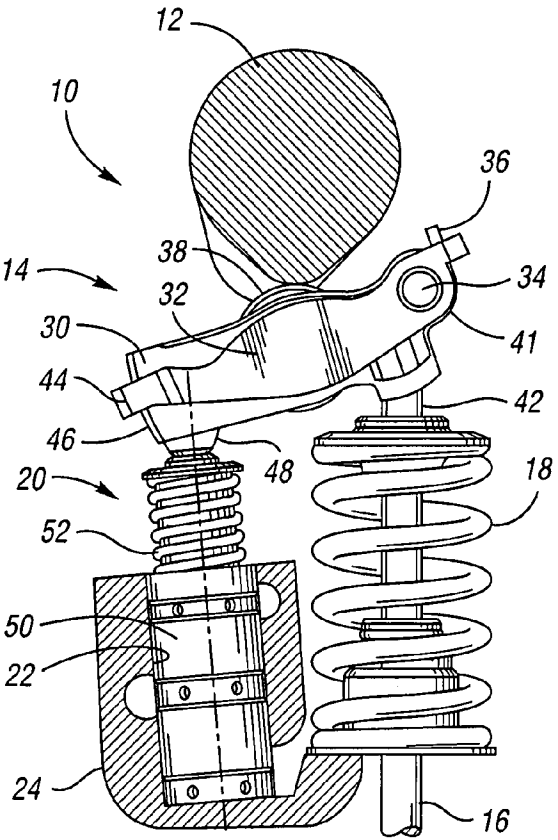
FIG. 1*b* is a vertical cross-sectional view of a valvetrain assembly in FIG. 1*a* wherein the low lift cam controls lost motion in the stationary hydraulic lash adjuster and the high lift cam controls lost motion between the arms of the two-step rocker arm.
Figure 1A:
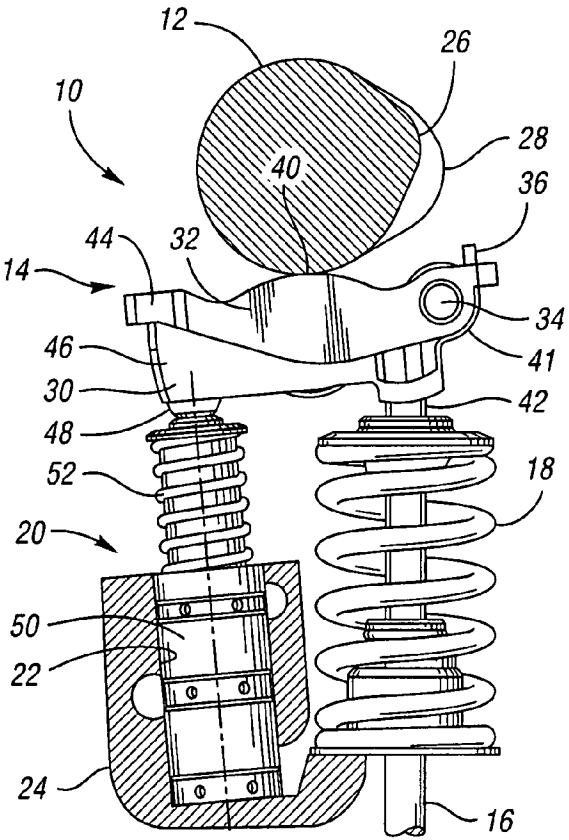
FIG. 1*a* is a vertical cross-sectional view of a valvetrain assembly in accordance with the invention.

FIGS. 1*a*, 1*b*, and 1*c* show different positions of the two-step rocker arm 14 and deactivating stationary lash adjuster 20 when the engine valve 16 is deactivated (i.e., zero-lift mode). The two-step rocker arm 14 may be implemented, by way of example, as that described in the above referenced U.S. Pat. No. 6,769,387, entitled "Compact Two-Step Rocker Arm", or in any other suitable configuration. Also, the deactivating stationary lash adjuster 20 may be implemented as that described above, or in any other suitable configuration. Returning to FIG. 1*a*, at this position, the high-lift cam lobes 28 and low-lift lobe 26 are on the base circle. The kinematics of the ensuing lost motion at the two-step rocker arm 14 and the stationary lash adjuster 20 depends on the relative strengths of the biasing springs associated with the rocker and the stationary lash adjuster, respectively. If the biasing spring 52 in the stationary lash adjuster 20 does not apply a turning moment to the low lift inner arm 30 that is larger than that from the rocker's biasing spring 36, the two-step rocker arm 14 will rotate as a solid body, following the high-lobe cam 28 lift. The initial lost motion takes place entirely at the stationary lash adjuster 20. The lost-motion stroke capacity at the stationary lash adjuster 20 has to be designed to accommodate the low-lift cam lobe's 26 maximum lift such that the lost motion will be completed without lifting the engine poppet valve 16 on which the respective low-lift inner arm 30 is now pivoted. Subsequently, the slidable inner body (plunger) 48 of the stationary lash adjuster 20 will land on a dead stop, and the remaining lost motion, following the high-lift cam lobe 28, takes place between the two arms of the rocker 14 against the rocker biasing spring 36.

If, however, as illustrated in FIGS. 1*b* and 1*c*, the turning moment applied to the low-lift inner rocker arm 30 by the stationary lash adjuster biasing spring 52 is larger than that applied by the rocker biasing spring 36, the lost motion at the stationary lash adjuster 20 is controlled by the low-lift cam lobe 26. The high-lift cam lobes 28 then only cause a relative rotational lost motion between the two arms 30, 32 of the rocker 14. Hence, for as long as the stationary lash adjuster biasing spring 52 does not become solid (i.e. the plunger 48 is not locked to the body 50), and the proper lost motion stroke capacity to accommodate the low-lift cam lobe 26 displacement exists, there will not be a "landing" contact between the moving and the stationary parts of the stationary lash adjuster 20.

As shown in FIG. 1*b*, the lost motion of the stationary hydraulic lash adjuster 20 is defined by the low-lift cam lobe 26, and the high lift cam lobe 28 causes further displacement of the outer arms 32, and therefore causes lost motion between the inner and outer arms 30, 32. Accordingly, FIG. 1*b* illustrates simultaneous lost motion in the two-step rocker 14 and in the deactivating stationary lash adjuster 20.

In FIG. 1*c*, the deactivating stationary lash adjuster 14 has almost returned to its fully extended position, and most lost motion is achieved within the two-step rocker arm 14 as the inner and outer arms 30, 32 are separated by the high-lift cam 28 against the bias of the spring 36.

Figure 2:
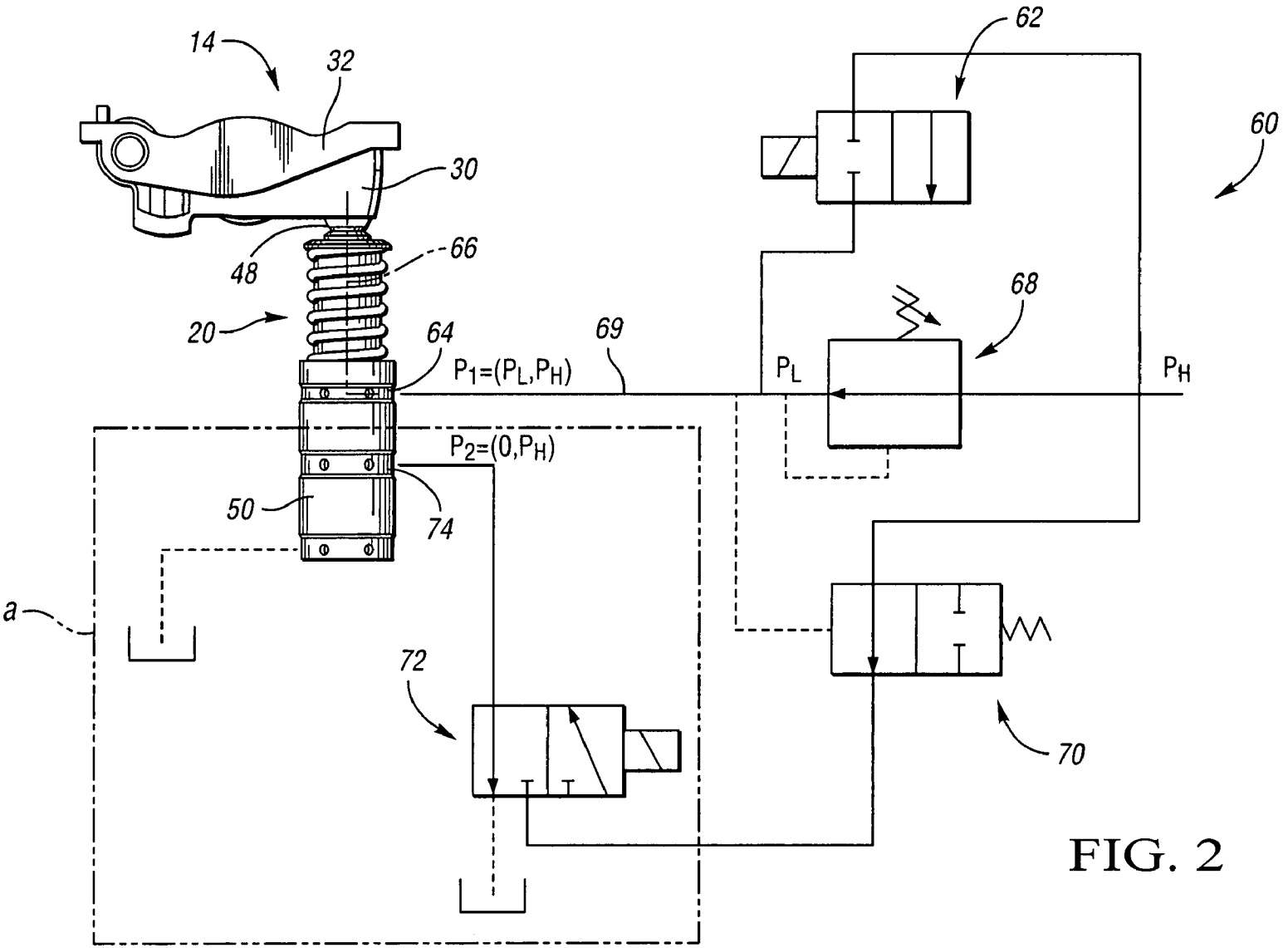
FIG. 2 is a schematic diagram of a hydraulic system for controlling actuation of the stationary hydraulic lash adjuster and two-step rocker arm of FIGS. 1*a–c;*

Turning to FIG. 2, a hydraulic actuation circuit 60 is shown for controlling the locking and unlocking of the two-step rocker 14 and deactivating stationary lash adjuster 20 to achieve lost motion. As shown, the hydraulic actuation circuit 60 receives available line pressure ($P_H$) from the engine. This line pressure is fed to a two-way/two-position solenoid valve 62 which is openable for delivering the high line pressure into the port 64 of the stationary hydraulic lash adjuster 20 in the energized state of valve 62. This fluid is then fed up to the two-step rocker arm 14 via the route schematically illustrated by the dashed line 66 in FIG. 2. This high pressure fluid is operative to cause a locking mechanism, as described previously, to lock the inner and outer arms 30, 32 of the rocker arm assembly 14 together so that the rocker arm 14 operates as a solid body, and the high lift cam lobe 28 controls its movement. When the solenoid valve 62 is de-energized as shown, the line pressure $P_H$ is fed through a pressure regulator 68, which reduces the output pressure to a reduced pressure ($P_L$) which is fed into the port 64 and into the two-step rocker arm 14 to unlock the inner and outer arms 30, 32 of the rocker arm 14 to allow lost motion within the rocker arm 14. When the solenoid valve 62 is de-energized, and low pressure fluid ($P_L$) is present at the left side of the pressure regulator 68, as viewed in FIG. 2, and the piloted check valve 70 is open to allow the high line pressure ($P_H$) to reach the three-way/two-position solenoid valve 72, which controls deactivation (deactivation enables lost motion) of the stationary hydraulic lash adjuster 20. Accordingly, the piloted check valve 70 prevents unlocking (deactivation) of the stationary hydraulic lash adjuster 20 when the two-step rocker arm 14 is locked (i.e., high-lift cam lobes are controlling motion) in order to prevent a hard landing between moving and stationary parts within the stationary hydraulic lash adjuster. The three-way/two-position solenoid valve 72 is selectively openable to allow the high line pressure ($P_H$) fluid into the port 74 of the stationary hydraulic lash adjuster to unlock the plunger 48 of the stationary hydraulic lash adjuster for movement with respect to the body 50 to allow lost motion (valve deactivation) within the stationary hydraulic lash adjuster 20.

Accordingly, it is ensured by the features of the hydraulic control circuit 60 that the deactivation can take place only when the low-lift cam lobe 26 is the controlling motion generator. The hydraulic circuit 60 controls the actuation of the two-step rocker 14, switching between high- and lo-lift modes, as well as the deactivation from the low-lift mode. Again, the on/off hydraulic valve 62 switches the pressure feed to the rocker 14 between a low threshold value (set by the biasing spring of the respective actuation pin) and the line pressure in the engine lubrication circuit. The low pressure is maintained by the pressure reducing valve 68. The two-position, spring-biased, and piloted check valve 70 ensures that if the pressure in the rocker feed line 69 is set to high pressure, i.e., high-lift cam lobe is active, then, regardless of the setting of the deactivation valve 72, the line to the deactivation port 74 is blocked. This ensures that deactivation can take place, by energizing the on/off hydraulic valve 72 only when the pressure in the rocker feed line 69 is at the low threshold value, i.e. the low-lift cam lobe 26 is the controlling motion generator. This safety feature not only eliminates a hard landing of the sliding inner part of the lash adjuster 20 against a dead stop, but also prevents an un-intended partial lifting of the engine poppet valve 16 under the control of the high-lobe cams 28 during deactivation. The timing control of each on/off hydraulic valve with respect to engine cycle will also be considered separately.

An alternative connection to the deactivation port is outlined in commonly assigned U.S. Pat. No. 6,557,518, which is hereby incorporated by reference in its entirety, where a continuous circulation through the port is maintained to eliminate the aeration effects detrimental to rapid actuation of the latching elements. This patent describes a cylinder deactivation apparatus which includes a simplified hydraulic circuit that provides oil to lash adjusters and to cylinder deactivation control passages through restricted passages adjacent the lash adjusters. A control valve, when open, delivers full pressure oil to the lash adjusting mechanisms while the restricted passages allow oil flow to purge air from the control passages but limit control oil pressure so that the valves are operated normally. When the control valve is closed, pressure in the control passages quickly increases, deactivating the valves of the deactivation cylinders. The flow of oil through the control passages when the valve is open is adequate to purge gaseous vapors such as air from the control passages and maintain the system in condition for prompt deactivation of the cylinders when the valve is closed.

Figure 2A:
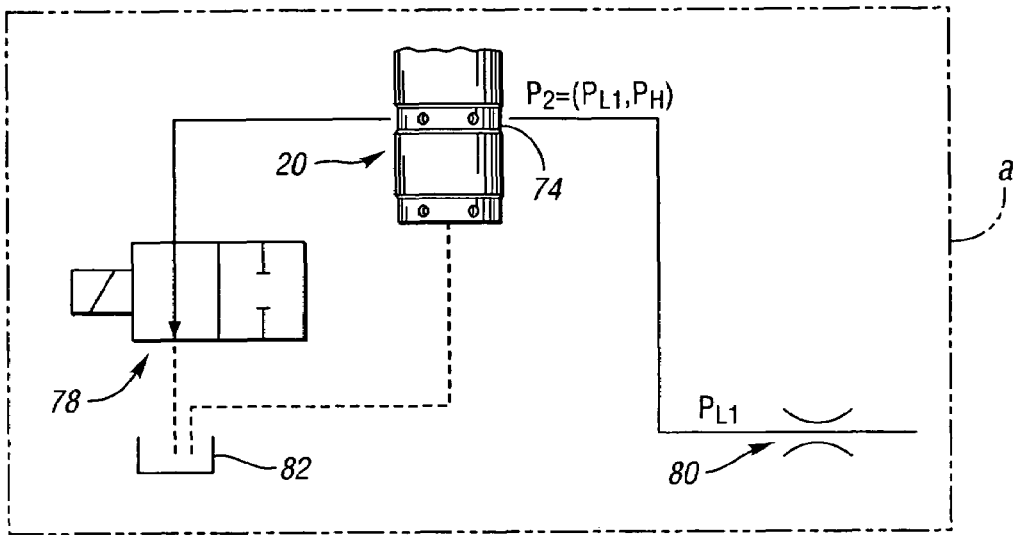
FIG. 2*a* shows a partial schematic diagram of an alternative hydraulic actuation circuit replacing portion a of FIG. 2.

Turning to FIG. 2*a*, an alternative embodiment of the deactivation portion of the hydraulic actuation circuit 60 of FIG. 2 is shown, wherein the components in the box a of FIG. 2 are replaced by the components in the box a of FIG. 2*a*. Specifically, the three-way/two-position solenoid valve 72 for the deactivation of the stationary hydraulic lash adjuster 20 is replaced by a two-way/two position valve 78 downstream of the stationary hydraulic lash adjuster deactivation port 74. Upstream of the stationary hydraulic lash adjuster 20 there is a properly sized orifice 80 which causes the line pressure $P_H$ to drop to a level $P_{L1}$, below the deactivation pressure of the stationary hydraulic lash adjuster 20. Blocking the line to the oil sump 82 causes the line pressure feeding the stationary hydraulic lash adjuster 20 to increase to the high pressure $P_H$ and cause deactivation. This configuration assures that the line feeding the deactivation is full at all times to provide quick response capability and operation free of aeration.

Figure 3:
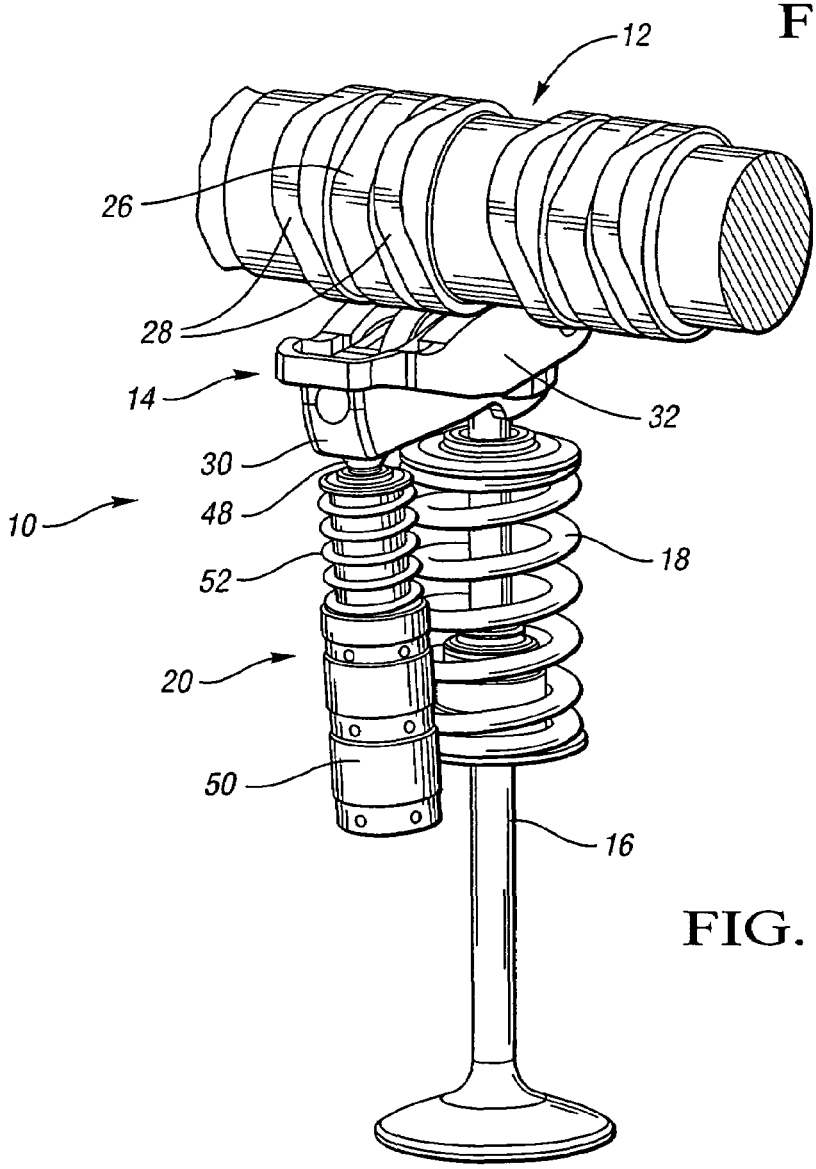
FIG. 3 shows a partial isometric view of the valvetrain system of FIGS. 1*a–c*.

Also to be noted is the fact that the proposed two-step valve lift plus valve deactivation functions can, alternatively, be achieved all in the same valvetrain component, e.g. the rocker arm. However, if the lash-adjuster contact at one end of the one of the arms of the rocker has no inherent reaction to a twist-moment, two symmetrical outer arms would be required to maintain balance. This could pose a packaging challenge due to the increased size of the rocker. Even the two-step rocker, like the one shown in FIG. 3, is bigger than the conventional single-step rocker. Also, with a single hydraulic-communication path going into the rocker arm, switching between three steps would require the actuation pressure to be controlled within three distinct zones, rather than a high and a low-threshold pressure zone that is required for a two-step rocker.

In summary, a two-step switchable rocker 14 is provided where the arm 30 that contacts the engine poppet valve 16 at one end is supported by a lost-motion lash-adjuster 20 at the other end. This valvetrain 10 is capable of operating in three distinct modes. The combination of a two-step rocker 14 with a deactivating lash adjuster 20 results in dividing the total lost motion, dictated by the high-lift cam lobes 28, into two parts: one at the lash adjuster 20, and one at the two-step rocker 14. Hence, the length of the lash adjuster 20 does not have to be based on the full lost-motion stroke which would have been the case with a conventional single-step rocker. This feature is important for packaging.

In addition to conventional criteria imposed by valvetrain dynamics, also considered is the selection of the lost-motion biasing springs 36, 52 in the two-step rocker and in the deactivating lash adjuster, respectively. The design ensures that the torque applied by the lash-adjuster biasing spring 52 on the arm 30 contacting the lash adjuster 20 remains larger than the torque applied by the two-step rocker biasing spring 36 during the entire deactivation lost motion. This feature eliminates the possibility of a hard-landing contact between the moving and the stationary parts of the deactivating lash adjuster, that is designed to accommodate the lost motion stroke dictated by the low-lift cam lobe.

Further, the hydraulic actuation control 60 for switching between the two step, i.e. high, and low valve lift, and the deactivation are done through separate feed lines. Hence, for each individual actuation, a simple on/off hydraulic valve is sufficient. A two-position piloted check valve 70 prevents engine poppet valve 16 deactivation when the high-lift cam lobes 28 are controlling the two-step rocker 14 motion. Combining the lubrication function into the same line as the two-step actuation requires only a pressure reducing valve operating between a high and a low-threshold pressure level. This is simpler than a more precise control of pressure between three levels if a single actuator, e.g. the rocker with a single feed line, were to achieve all three distinct states of valve lift.

While the best modes for carrying out the invention have been described in detail, those familiar with the art to which this invention relates will recognize various alternative designs and embodiments for practicing the invention within the scope of the appended claims.

The invention claimed is:

1. A valvetrain comprising:

a camshaft having low-lift and high-lift cams;

a two-step rocker arm assembly having first and second movable arms engaged with said low-lift and high-lift cams, respectively, and a rocker arm spring biasing said first arm relative to said second arm, wherein said first arid second arms are lockable together for high-lift mode, and unlockable for lost-motion mode; arid a deactivating stationary lash adjuster engaged with said two-step rocker arm assembly and having a lost-motion spring, said deactivating stationary lash adjuster being unlockable to enable lost-motion movement against said lost-motion spring when unlocked;

wherein said two-step rocker arm assembly and deactivating stationary lash adjuster are unlockable simultaneously for improved lost-motion control and to minimize required length of said deactivating stationary lash adjuster.

2. The valvetrain of claim 1, wherein said two-step rocker arm assembly and deactivating stationary lash adjuster are lockable and unlockable by two on/off hydraulic valves in a hydraulic circuit.

3. The valvetrain of claim 2, further comprising a piloted check valve in said hydraulic circuit operatively connected between said two on/off hydraulic valves to prevent unlocking of said deactivating stationary lash adjuster when said two-step rocker arm assembly is locked to prevent a hard landing between moving and stationary parts within the deactivating stationary lash adjuster.

4. The valvetrain of claim 2, wherein said two on/off hydraulic valves comprise a two-way two-position valve and a three-way two-position valve.

5. The valvetrain of claim 1, wherein said lost-motion spring in the deactivating stationary lash adjuster is stiffer than said rocker arm spring so that both springs may be compressed simultaneously to achieve lost motion in both the deactivating stationary lash adjuster arid the two-step rocker arm assembly.

6. The valvetrain of claim 1, wherein said two-step rocker arm assembly and deactivating stationary lash adjuster enable operation of an engine poppet valve in low-lift mode, high-lift mode arid zero-lift mode.

7. An overhead cam valvetrain comprising:

a camshaft having low-lift and high-lift cams;

a two-step rocker arm assembly having first and second movable arms engaged with said low-lift and high-lift cams, respectively, and a rocker arm spring biasing said first arm relative to said second arm, wherein said first arid second arms are lockable together for high-lift mode, and unlockable for lost-motion low-lift mode; and a deactivating stationary lash adjuster engaged with said two-step rocker arm assembly and having a lost-motion spring, said deactivating stationary lash adjuster being unlockable to enable lost-motion movement against said lost-motion spring when unlocked;

wherein said two-step rocker arm assembly and deactivating stationary lash adjuster are unlockable simultaneously for improved lost-motion control and to minimize required length of said deactivating stationary lash adjuster, and wherein locking and unlocking of said two-step rocker arm assembly and deactivating stationary lash adjuster is controlled by two on/off hydraulic switches in a hydraulic circuit to enable operation of an engine poppet valve in low-lift mode, high-lift mode and zero-lift mode.

8. The valvetrain of claim 7, further comprising a piloted check valve in said hydraulic circuit operatively connected between said two on/off hydraulic switches to prevent unlocking of said deactivating stationary lash adjuster when said two-step rocker arm assembly is locked to prevent a hard landing between moving and stationary parts within the deactivating stationary lash adjuster.

9. The valvetrain of claim 7, wherein said lost-motion spring in the deactivating stationary lash adjuster is stiffer than said rocker arm spring so that both springs may be compressed simultaneously to achieve lost motion in both the deactivating stationary lash adjuster arid the two-step rocker arm assembly.

* * * * *